US010706805B2

(12) United States Patent
Kim et al.

(10) Patent No.: US 10,706,805 B2
(45) Date of Patent: Jul. 7, 2020

(54) SOURCE DRIVER USING AN INTERPOLATION METHOD AND DISPLAY DRIVER INCLUDING THE SAME

(71) Applicant: SAMSUNG ELECTRONICS CO., LTD., Suwon-si, Gyeonggi-Do (KR)

(72) Inventors: Pan Soo Kim, Yongin-si (KR); Jin Han Kim, Suwon-si (KR); Mi Ri Park, Hwaseong-si (KR); Myung Ho Seo, Zhubei (TW); Hyun Ji Yoon, Daegu (KR); Jin Chul Choi, Goyang-si (KR)

(73) Assignee: SAMSUNG ELECTRONICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 16/150,419

(22) Filed: Oct. 3, 2018

(65) Prior Publication Data

US 2019/0304395 A1 Oct. 3, 2019

(30) Foreign Application Priority Data

Mar. 30, 2018 (KR) ..... 10-2018-0037091

(51) Int. Cl.
*G09G 3/36* (2006.01)

(52) U.S. Cl.
CPC ..... *G09G 3/3685* (2013.01); *G09G 3/3607* (2013.01); *G09G 3/3696* (2013.01); *G09G 2310/027* (2013.01); *G09G 2320/0276* (2013.01)

(58) Field of Classification Search
CPC ..... G09G 3/3685
USPC ..... 345/89
See application file for complete search history.

(56) References Cited

U.S. PATENT DOCUMENTS

| | | | | |
|---|---|---|---|---|
| 7,714,758 | B2 | 5/2010 | Ko et al. | |
| 8,111,184 | B2 | 2/2012 | Tsuchi | |
| 8,344,978 | B2 | 1/2013 | Kim et al. | |
| 8,379,000 | B2 | 2/2013 | Tsuchi | |
| 8,970,573 | B2 | 3/2015 | Knausz et al. | |
| 2007/0115271 | A1* | 5/2007 | Seo | G09G 3/3688 345/204 |
| 2008/0297390 | A1 | 12/2008 | Ko et al. | |
| 2009/0085788 | A1* | 4/2009 | Yamazaki | H03F 3/45183 341/153 |

(Continued)

FOREIGN PATENT DOCUMENTS

| | | |
|---|---|---|
| KR | 10-2008-0105977 | 12/2008 |
| KR | 10-1170620 | 7/2012 |

*Primary Examiner* — Long D Pham
(74) *Attorney, Agent, or Firm* — F. Chau & Associated, LLC

(57) ABSTRACT

A source driver includes a buffer unit including a plurality of unit buffers corresponding to a plurality of source lines, where each of the plurality of unit buffers includes a plurality of input terminals and an output terminal connected to at least one of the plurality of source lines, and a decoder unit configured to receive image data and a plurality of gamma voltages, and input at least one of the plurality of gamma voltages to the plurality of input terminals of each of the plurality of unit buffers, using the image data. The decoder unit inputs two or more of the gamma voltages, having different magnitudes, to the plurality of input terminals of each of first unit buffers among the plurality of unit buffers, and the first unit buffers output a gradation voltage higher than a first voltage and lower than a second voltage.

18 Claims, 13 Drawing Sheets

(56) References Cited

U.S. PATENT DOCUMENTS

| | | | | |
|---|---|---|---|---|
| 2009/0109077 | A1 | 4/2009 | Tsuchi et al. | |
| 2011/0279298 | A1 | 11/2011 | Kim et al. | |
| 2015/0310812 | A1* | 10/2015 | Chen | G09G 3/3696 345/691 |
| 2016/0098951 | A1* | 4/2016 | Kim | G09G 3/3688 345/209 |

* cited by examiner

SOURCE DRIVER USING AN INTERPOLATION METHOD AND DISPLAY DRIVER INCLUDING THE SAME

CROSS-REFERENCE TO RELATED APPLICATION

This application claims priority under 35 U.S.C. § 119 to Korean Patent Application No. 10-2018-0037091, filed on Mar. 30, 2018 in the Korean Intellectual Property Office, the disclosure of which is incorporated by reference herein in its entirety.

TECHNICAL FIELD

Exemplary embodiments of the present inventive concept relate to a source driver and a display driver including the same.

DISCUSSION OF RELATED ART

Examples of display devices used in electronic devices for displaying images, such as TV sets, laptop computers, monitors, mobile devices, or the like, include liquid crystal displays (LCD), organic light emitting displays (OLED), or the like. Such a display device may include a display panel having a plurality of pixels, and a display driver for applying an electric signal to the plurality of pixels. Images may be displayed in response to the electrical signals provided to the plurality of pixels by the display driver.

SUMMARY

According to an exemplary embodiment of the present inventive concept, a source driver includes a buffer unit including a plurality of unit buffers corresponding to a plurality of source lines, where each of the plurality of unit buffers includes a plurality of input terminals and an output terminal connected to at least one of the plurality of source lines, and a decoder unit configured to receive image data and a plurality of gamma voltages, and input at least one of the plurality of gamma voltages to the plurality of input terminals of each of the plurality of unit buffers, using the image data. The decoder unit inputs two or more of the plurality of gamma voltages, having different magnitudes, to the plurality of input terminals of each of first unit buffers among the plurality of unit buffers, and the first unit buffers output a gradation voltage higher than a first voltage and lower than a second voltage.

According to an exemplary embodiment of the present inventive concept, a display driver includes a buffer unit including a plurality of unit buffers, where each of the plurality of unit buffers includes an output terminal and a plurality of input terminals, a plurality of gamma lines configured to provide a plurality of gamma voltages, and a decoder unit connecting two or more gamma lines among the plurality of gamma lines to the plurality of input terminals included in each of first unit buffers among the plurality of unit buffers, where the first unit buffers output a gradation voltage within a predetermined range.

According to an exemplary embodiment of the present inventive concept, a source driver includes a buffer unit including a plurality of unit buffers, where each of the plurality of unit buffers includes a plurality of first input terminals configured to receive first input voltages, a second input terminal configured to receive an output voltage through a feedback path, and an output terminal configured to output the output voltage, and the output voltage has an average value of the first input voltages, and a decoder unit configured to control the output voltage of each of the plurality of unit buffers, using image data, and when the image data is within a predetermined range, to select a gamma voltage having a magnitude different from a magnitude of the output voltage, as at least one of the first input voltages.

BRIEF DESCRIPTION OF DRAWINGS

The above and other features of the present inventive concept will be more clearly understood by describing in detail exemplary embodiments thereof with reference to the accompanying drawings.

DETAILED DESCRIPTION OF THE EMBODIMENTS

Figure 1:
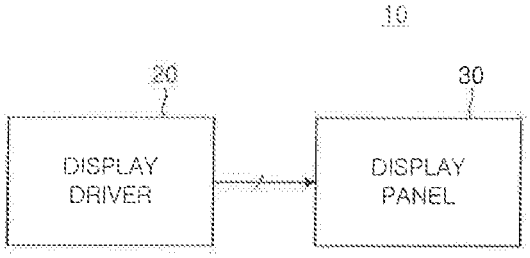
FIG. 1 is a schematic block diagram of a display device including a display driver according to an exemplary embodiment of the present inventive concept.

Exemplary embodiments of the present inventive concept provide a source driver, in which a chip size of a display driver may be decreased by reducing the number of gamma lines supplying gamma voltages, and a brightness reversal phenomenon due to an increase in a scan rate of a display device may be significantly reduced. Exemplary embodiments of the present inventive concept also provide a display driver including the source driver.

Hereinafter, exemplary embodiments of the present inventive concept will be described with reference to the accompanying drawings. Like reference numerals may refer to like elements throughout this application.

FIG. 1 is a schematic block diagram of a display device including a display driver according to an exemplary embodiment of the present inventive concept. Referring to FIG. 1, a display device 10 according to an exemplary embodiment of the present inventive concept may include a display driver 20 and a display panel 30.

The display driver 20 may include a gate driver and a source driver that input image data transmitted to the display panel 30 by an external processor, a timing controller that controls the gate driver and the source driver, and the like. The timing controller may control the gate driver and the source driver in response to a vertical synchronization signal and a horizontal synchronization signal.

A processor, transmitting image data to the display driver 20, may be an application processor (AP) in a mobile device, or may be a central processing unit (CPU) in a desktop computer, a laptop computer, a television, or the like. For example, the processor may be understood as a processing device having an arithmetic function. The processor may generate image data to be displayed through the display device 10, or may receive image data from a memory, a communications module, or the like to transmit the image data to the display driver 20.

Figure 2:
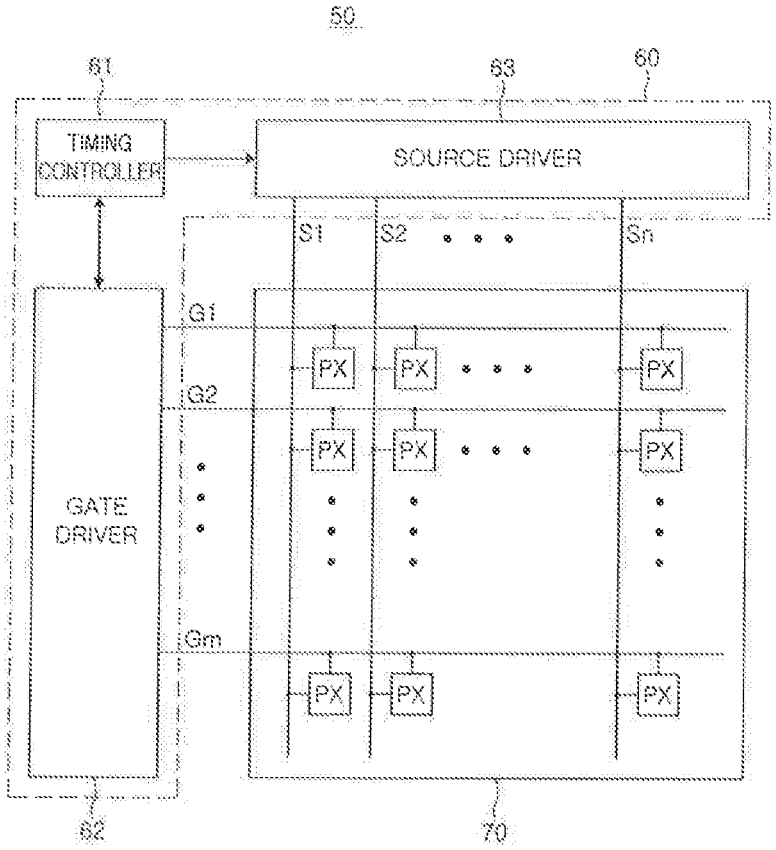
FIG. 2 is a schematic block diagram of a display device including a display driver according to an exemplary embodiment of the present inventive concept.

FIG. 2 is a schematic block diagram of a display device including a display driver according to an exemplary embodiment of the present inventive concept.

Referring to FIG. 2, a display device 50 may include a display driver 60 and a display panel 70. The display driver 60 may include a timing controller 61, a gate driver 62, a source driver 63, and the like. The display panel 70 may include a plurality of pixels PX disposed along a plurality of gate lines G1 to Gm and a plurality of source lines S1 to Sn.

In an exemplary embodiment of the present inventive concept, the display device 50 may display an image on a frame-by-frame basis. Time required to display a single frame may be defined by a vertical period, and the vertical period may be determined by a scan rate of the display device 50. In an exemplary embodiment of the present inventive concept, when the scan rate of the display device 50 is 60 Hz, the vertical period may be 1/60 second, or about 16.7 msec.

During one vertical period, the gate driver 62 may scan each of the plurality of gate lines G1 to Gm. Time during which the gate driver 62 scans each of the plurality of gate lines G1 to Gm may be defined as a horizontal period, and during one horizontal period, the source driver 63 may provide a gradation voltage to be input to the pixels PX. The gradation voltage may be a voltage output by the source driver 63, based on image data, and the brightness of respective pixels PX may be determined by the gradation voltage.

Figure 3:
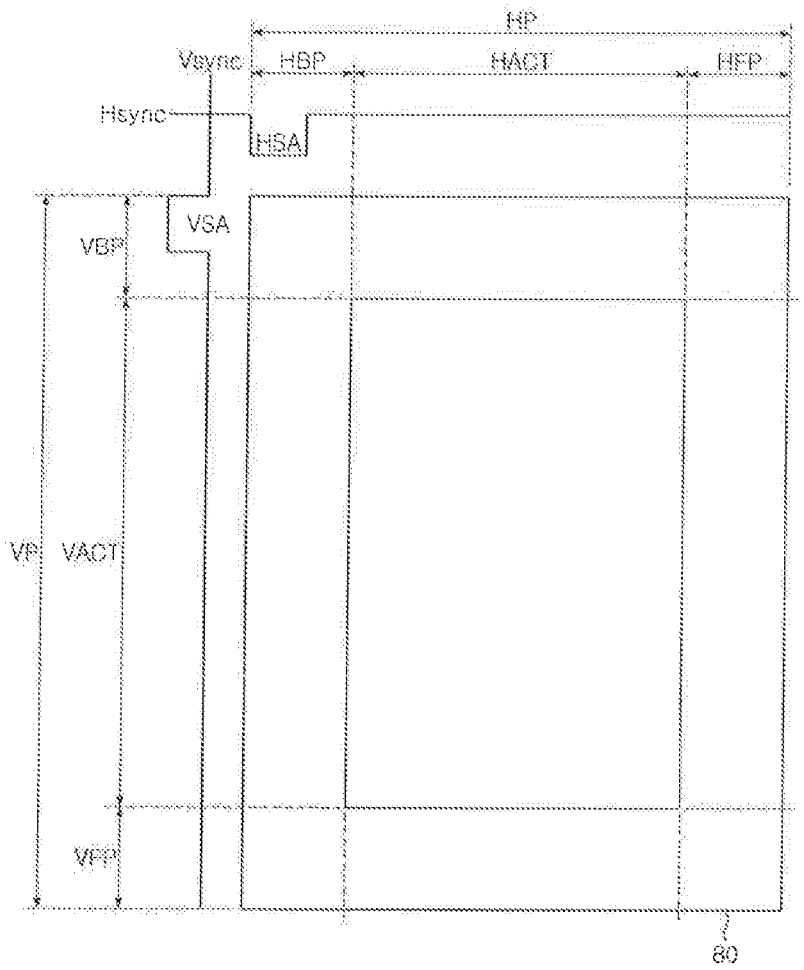
FIG. 3 is a drawing illustrating operations of a display device according to an exemplary embodiment of the present inventive concept.

FIG. 3 is a drawing illustrating operations of a display device according to an exemplary embodiment of the present inventive concept.

Referring to FIG. 3, a display panel 80 may be operated by a vertical synchronization signal Vsync having a vertical period VP, and a horizontal synchronization signal Hsync having a horizontal period HP. The vertical period VP may include a first vertical porch period VBP, a vertical active period VACT, and a second vertical porch period VFP. The first vertical porch period VBP may include a vertical speed period VSA. In an exemplary embodiment of the present inventive concept, the first vertical porch period VBP may be a vertical back porch period, and the second vertical porch period VFP may be a vertical front porch period.

The horizontal period HP may include a first horizontal porch period HBP, a horizontal active period HACT, and a second horizontal porch period HFP. The first horizontal porch period HBP may include a horizontal speed period HSA. In an exemplary embodiment of the present inventive concept, the first horizontal porch period HBP may be a horizontal back porch period, and the second horizontal porch period HFP may be a horizontal front porch period.

A scan for a plurality of gate lines included in the display panel 80 and a data input for pixels connected to the scanned gate lines may be performed in the vertical and horizontal active periods VACT and HACT. For example, the gate lines may be sequentially scanned during the vertical active period VACT, and data input for the pixels connected to the scanned gate lines may be performed during the horizontal active period HACT.

As scan rates of display panels have gradually increased, the vertical period VP and the horizontal period HP may be reduced. For example, in the case in which the vertical period VP and the horizontal period HP are reduced, the source driver may be required to input image data to pixels within a relatively short period of time, and to this end, unit buffers outputting gradation voltages may be required to operate at a relatively high speed. As the unit buffers operate at a high speed, gradation voltages may be input to pixels for a relatively short horizontal period HP, while a speed difference in voltages input to respective unit buffers may be reflected in gradation voltages output by the respective unit buffers as is.

The source driver may receive a plurality of gamma voltages together with image data, and may provide, as an input voltage, at least a portion of the plurality of gamma voltages to the unit buffers, based on the image data. The unit buffers may include a plurality of input terminals receiving the gamma voltages, and may operate according to an interpolation method that outputs an average value of the gamma voltages, input to the plurality of input terminals, as a gradation voltage. For example, when the unit buffers are implemented by the interpolation method as described above, a chip size of the display driver may be reduced by removing a portion of a plurality of gamma lines.

As described above, since the horizontal period HP of the display panel 80 is reduced to require high-speed unit buffers, a slew rate difference of the gamma voltages input to the unit buffers may be reflected in the gradation voltages output by the unit buffers. For example, in the case in which the unit buffers receive two or more gamma voltages through a plurality of input terminals, combination methods of the gamma voltages input to the unit buffers may be different from one another, depending on magnitudes of gradation voltages output by the respective unit buffers, which may lead to a difference in slew rates of the gradation voltages. Thus, the brightness of pixels due to the gradation voltages output by the unit buffers may be reversed. For example, when a first unit buffer outputs a first gradation voltage and a second unit buffer outputs a second gradation voltage lower than the first gradation voltage, the output from the first unit buffer may be less than the output from the second unit buffer, during a portion of the horizontal period HP, due to a difference in combination methods of gamma voltages received by the respective first and second unit buffers.

Thus, in an exemplary embodiment of the present inventive concept, to prevent such a problem, the difference in the combination of gamma voltages input to respective unit buffers may be significantly reduced. For example, in an exemplary embodiment of the present inventive concept, two or more gamma voltages having different magnitudes may be input to the unit buffers, outputting gradation voltages included within a predetermined range. All of the unit buffers, outputting gradation voltages within a predetermined range, may generate the gradation voltages depending on an interpolation method, regardless of whether directly inputting gamma voltages, having the same magnitude as that of the gradation voltages output by the unit buffers, to the unit buffers. Thus, an increase rate of the gamma voltages input to the unit buffers, e.g., a difference in a slew rate, may be significantly reduced, and a problem in which the brightness of pixels is reversed may be prevented from occurring.

Figure 4:
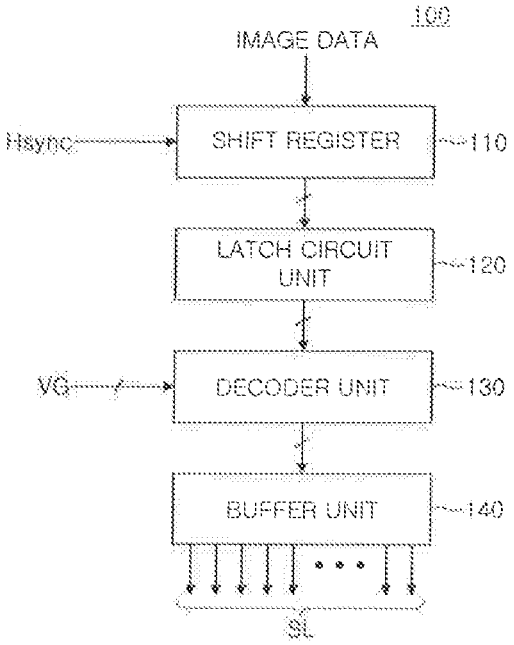
FIG. 4 is a schematic block diagram of a source driver according to an exemplary embodiment of the present inventive concept.

FIG. 4 is a schematic block diagram of a source driver according to an exemplary embodiment of the present inventive concept.

With reference to FIG. 4, a source driver 100 according to an exemplary embodiment may include a shift register 110, a latch circuit unit 120, a decoder unit 130, a buffer unit 140, and the like. In an exemplary embodiment of the present inventive concept, the latch circuit unit 120 may include a sampling circuit sampling data, and a holding latch storing data sampled by the sampling circuit. Respective constituent elements 110 to 140 included in the source driver 100 are not limited to those illustrated in the exemplary embodiment of FIG. 4, and may be variously changed to have various forms.

The shift register 110 may control operating timings of a plurality of respective sampling circuits included in the latch circuit unit 120, in response to the horizontal synchronization signal Hsync. The horizontal synchronization signal Hsync may be a signal having a predetermined period. The latch circuit unit 120 may perform sampling on image data according to a shift sequence of the shift register 110 and may store the sampled image data. The latch circuit unit 120 may output the image data to the decoder unit 130. The decoder unit 130 may be a digital-to-analog converter DAC.

The decoder unit 130 may receive a plurality of gamma voltages VG together with the image data. In an exemplary embodiment of the present inventive concept, the number of the plurality of gamma voltages VG may be determined depending on the number of bits of the image data. For example, when the image data is 8-bit data, the number of the plurality of gamma voltages VG may be 256 or less, and when the image data is 10-bit data, the number of the plurality of gamma voltages VG may be 1024 or less.

The buffer unit 140 may include a plurality of unit buffers implemented by operational amplifiers, and the plurality of unit buffers may be connected to a plurality of source lines SL. Each of the plurality of unit buffers may include a plurality of input terminals. The decoder unit 130 may select at least a portion of the plurality of gamma voltages VG, based on the image data, to provide the selected gamma voltage to the input terminals of each of the plurality of unit buffers, as an input voltage. Each of the plurality of unit buffers may output an average value of the input voltage provided from the decoder unit 130 to the plurality of source lines SL, as a gradation voltage. Thus, for example, when the image data is 8-bit data, even in the case in which the number of a plurality of gamma lines, which input the plurality of gamma voltages VG to the decoder unit 130, is less than 256, the plurality of unit buffers may respectively output one of 256 gradation voltages.

Figure 5:
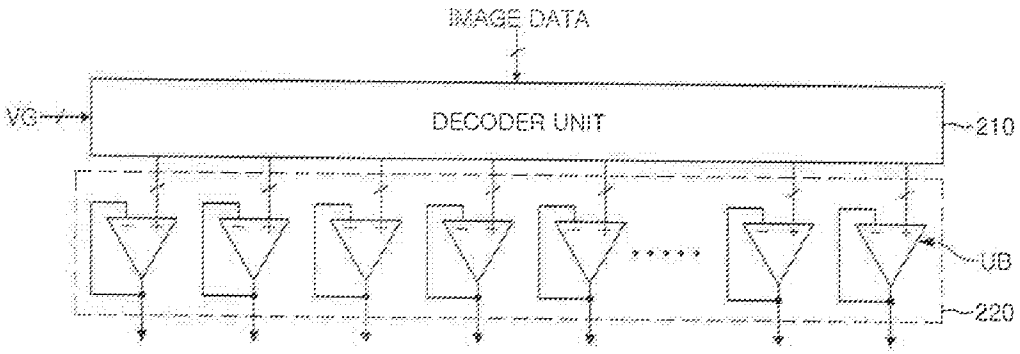
FIGS. 5 and 6 are drawings illustrating a structure of a source driver according to an exemplary embodiment of the present inventive concept.
Figure 6:
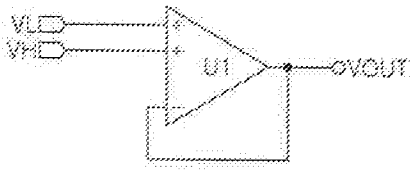

FIGS. 5 and 6 are drawings illustrating a structure of a source driver according to an exemplary embodiment of the present inventive concept.

Referring to FIG. 5, a source driver 200 according to an exemplary embodiment of the present inventive concept may include a decoder unit 210 and a buffer unit 220. The decoder unit 210 may receive the plurality of gamma voltages VG together with image data, and the number of the plurality of gamma voltages VG may be determined, depending on the number of bits of the image data. For example, when the image data have N bits, the number of the plurality of gamma voltages VG input to the decoder unit 210 may be $2^N$ or less.

The buffer unit 220 may include a plurality of unit buffers UB. Referring to FIG. 6, each of the unit buffers UB may include an operational amplifier U1, and may have a negative feedback structure in which an output terminal and an inverting input terminal of the operational amplifier U1 are connected to each other. The decoder unit 210 may select at least a portion of the plurality of gamma voltages VG, to provide the selected gamma voltage to a noninverting input terminal of the operational amplifier U1 as an input voltage. For example, the operational amplifier U1 may include two or more noninverting input terminals, and at least portions of the gamma voltages VG provided to the noninverting input terminals of one operational amplifier U1 as input voltages may have different magnitudes.

With reference to FIG. 6, the unit buffer UB may include two noninverting input terminals, and input voltages VL and VH input to the noninverting input terminals may have different values. For example, an output voltage VOUT of the operational amplifier U1 may be determined by an average value of the input voltages VL and VH. The output voltage VOUT of the operational amplifier U1 may be a gradation voltage input to at least one of a plurality of source lines included in a display panel.

The number of noninverting input terminals of the operational amplifier U1 may be determined depending on the number of bits of image data to which an interpolation method is applied, from among the bits of the image data. For example, in the case in which the interpolation method is only applied to one bit among the bits of the image data, the operational amplifier U1 may include two noninverting input terminals as illustrated in FIG. 6. On the other hand, when the interpolation method is applied to two bits among the bits of the image data, the operational amplifier U1 may include four noninverting input terminals.

Figure 7:
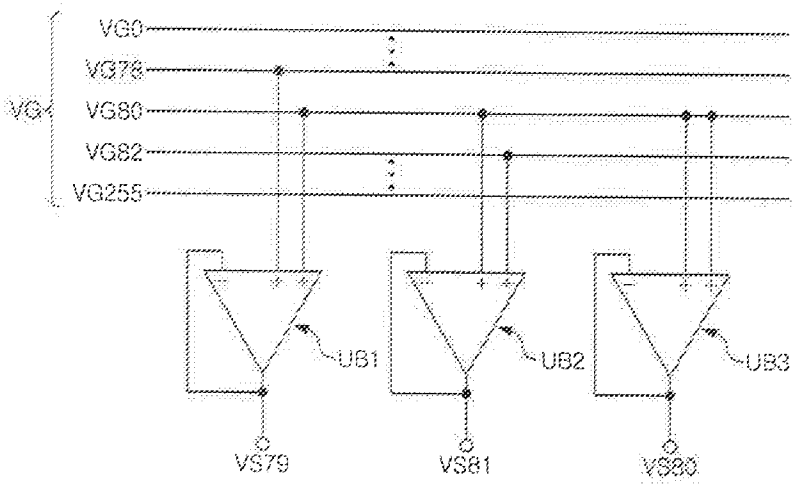
FIGS. 7 and 8 are drawings illustrating operations of a source driver according to an exemplary embodiment of the present inventive concept.
Figure 8:
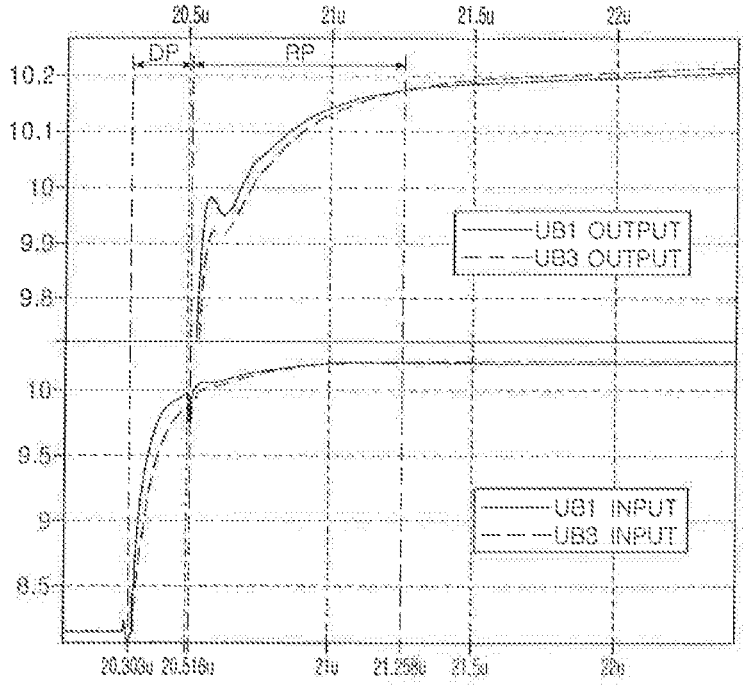

FIGS. 7 and 8 are drawings illustrating operations of a source driver according to an exemplary embodiment of the present inventive concept.

In an exemplary embodiment of the present inventive concept described with reference to FIGS. 7 and 8, it may be assumed that a source driver receives 8-bit image data and an interpolation method is applied to one bit thereof. Thus, the number of a plurality of gamma lines to input a plurality of gamma voltages VG0 to VG255 (e.g., the gamma voltage VG) to a decoder unit of the source driver may be less than 256. On the other hand, an operational amplifier included in each of unit buffers UB1 to UB3 may have two noninverting input terminals, and may output an average value of voltages input via the noninverting input terminals, as a gradation voltage.

Referring to FIG. 7, the plurality of unit buffers UB1 to UB3 may respectively receive at least a portion of the gamma voltages VG through the noninverting input terminals. For example, gamma voltages VG78 and VG80 corresponding to 78th and 80th grayscale gradations, respectively, may be input to the noninverting input terminals of the first unit buffer UB1, and a gradation voltage VS79 output by the first unit buffer UB1 may have a 79th grayscale gradation. Gamma voltages VG80 and VG82 corresponding to 81st and 83rd grayscale gradations, respectively, may be input to the noninverting input terminals of the second unit buffer UB2, and a gradation voltage VS81 output by the second unit buffer UB1 may have a 82nd grayscale gradation, because gamma voltages VG0 to VG255 are corresponding to first to 256th grayscale gradations. Also, gradation voltages VS0 to VS255 are corresponding to first to 256th grayscale gradations. The unit buffers UB1 and UB2 may output gradation voltages corresponding to gradations that may not be represented by the gamma voltages VG directly received by the decoder unit, using the interpolation method described above.

On the other hand, the third unit buffer UB3 may output a gradation voltage VS80 corresponding to an 80th grayscale gradation directly received by the decoder unit. Noninverting input terminals of the third unit buffer UB3 may commonly receive the gamma voltage VG80 having the same magnitude as the gradation voltage VS80 to be output. As a result, in the exemplary embodiment illustrated in FIG. 7, the third unit buffer UB3 may not generate a gradation voltage using the interpolation method, unlike the first and second unit buffers UB1 and UB2.

The noninverting input terminals of each of the unit buffers UB1 to UB3 may be connected to a gate terminal of a transistor included in the operational amplifier, and the transistor may be turned on or off by the gamma voltages VG input through the noninverting input terminals. In the case of the third unit buffer UB3, since the noninverting input terminals commonly receive one gamma voltage VG80, the input voltage of the third unit buffer UB3 may be slowly increased as compared with those of the first and second unit buffers UB1 and UB2.

FIG. 8 is a graph illustrating waveforms of input voltages and output voltages of the first unit buffer UB1 and the third unit buffer UB3. Referring to FIG. 8, a magnitude of the input voltage of the first unit buffer UB1 may increase faster than a magnitude of the input voltage of the third unit buffer UB3, which is why one gamma voltage VG80 may be commonly input to the noninverting input terminals of the third unit buffer UB3, as compared with the noninverting input terminals of the first unit buffer UB1 to which the gamma voltages VG78 and VG80 having different magnitudes are input.

As described above, as the scan rate of the display device increases and the horizontal period decreases, an operation speed of the unit buffers UB1 to UB3 may gradually increase. Thus, a difference in the input voltages of the unit buffers UB1 to UB3 is reflected in the output voltages of the unit buffers UB1 to UB3 as is. With reference to FIG. 8, the gradation voltage VS79 output by the first unit buffer UB1 may be higher than the gradation voltage VS80 output by the third unit buffer UB3 in a rising period RP of the output voltage after a predetermined delay time DP elapses, which may lead to a brightness reversal phenomenon of the display device.

A method of increasing a thickness of gamma lines transferring gamma voltages VG has been proposed to address the brightness reversal phenomenon described above. However, the method of increasing the thickness of gamma lines may only increase a slew rate of the unit buffers UB1 to UB3 to significantly reduce a period in which the brightness of gradation voltages is reversed, but may not prevent the occurrence of the brightness reversal phenomenon. Further, a source driver may be implemented in a full-decoder scheme in which all of the unit buffers UB1 to UB3 only receive one gamma voltage among the gamma voltages VG, to prevent the brightness reversal phenomenon. However, in the full-decoder scheme, since the gamma voltages VG corresponding to all grayscale levels to be represented should be supplied to gamma lines, the number of the gamma lines increases. For example, if the full-decoder scheme is applied to the exemplary embodiment illustrated in FIG. 7, a total of 256 gamma lines may be required.

According to an exemplary embodiment of the present inventive concept, to prevent the above-described problem, at least portions of gamma voltages input to noninverting input terminals of unit buffers, which output gradation voltages within a predetermined range, may be selected to have different values. For example, in an exemplary embodiment of the present inventive concept, all of the unit buffers may operate using an interpolation method to output gradation voltages. Thus, the source driver may be implemented with gamma lines of which the number is less than the number of grayscale levels to be expressed, and in addition, a brightness reversal phenomenon may be prevented from occurring in the display device. Hereinafter, detailed descriptions thereof will be provided with reference to FIGS. 9 to 11.

Figure 9:
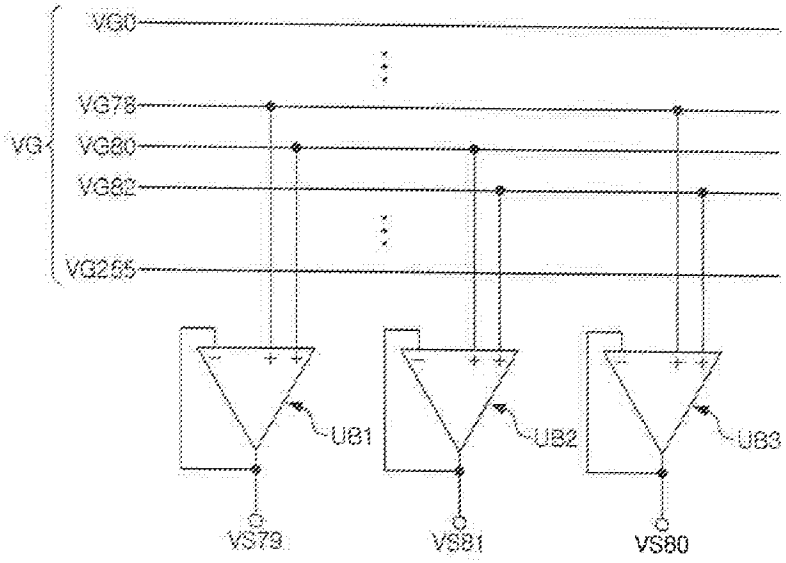
FIGS. 9 to 11 are drawings illustrating operations of a source driver according to an exemplary embodiment of the present inventive concept.
Figure 10:
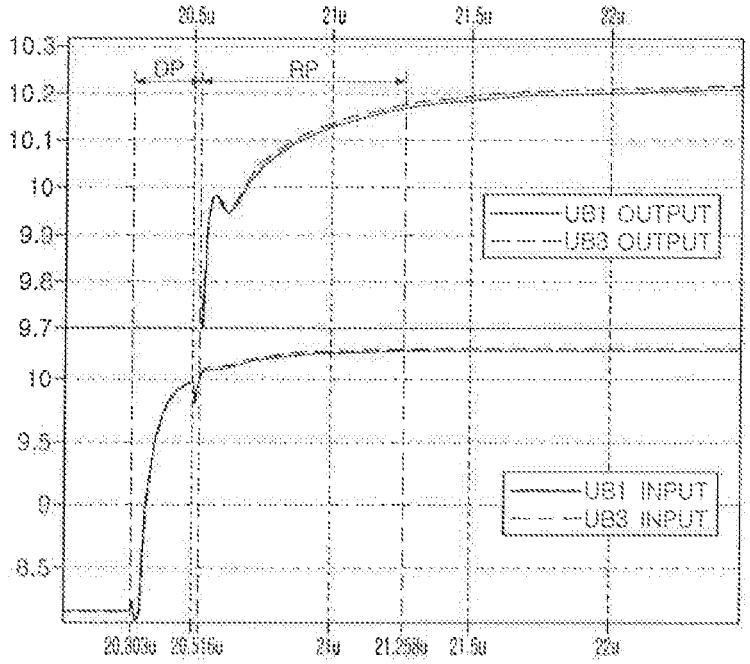
Figure 11:
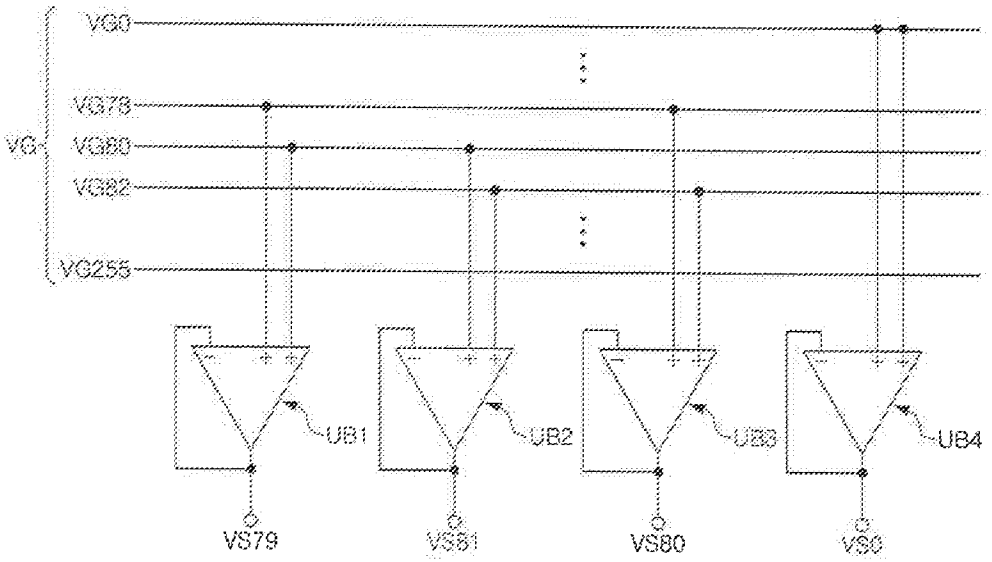

FIGS. 9 to 11 are drawings illustrating operations of a source driver according to an exemplary embodiment of the present inventive concept.

Referring to FIG. 9, it may be assumed that a source driver receives 8-bit image data and uses an interpolation method with respect to one bit, similar to the exemplary embodiment of FIG. 7. By applying the interpolation method thereto, the number of gamma voltages VG0 to VG255 (e.g., the gamma voltages VG) input to a decoder unit of the source driver may be less than 256. On the other hand, an operational amplifier included in each of the plurality of unit buffers UB1 to UB3 may have two noninverting input terminals, and may output an average value of voltages input via the noninverting input terminals, as a gradation voltage.

In an exemplary embodiment of the present inventive concept illustrated in FIG. 9, gradation voltages corresponding to grayscale levels that may be directly provided by the gamma voltages VG may be generated using the interpolation method. For example, the noninverting input terminals of the third unit buffer UB3 may be connected to a gamma line supplying a gamma voltage VG78 having a 78th grayscale gradation and a gamma voltage VG82 having a 82nd gradation. The third unit buffer UB3 may output a gradation voltage VS80 of an 80th grayscale gradation, which is an average gradation value of the gamma voltages VG78 and VG82 provided by the gamma lines connected to the noninverting input terminals.

In other words, in a manner different from the exemplary embodiment of FIG. 7 in which the gamma voltage VG80 having an $80^{th}$ grayscale gradation is commonly received to output the gradation voltage VS80 of the $80^{th}$ grayscale gradation, in FIG. 9, the third unit buffer UB3 may receive the gamma voltage VG78 of the 78th grayscale gradation and the gamma voltage VG82 of the 82nd grayscale gradation, to output the gradation voltage VS80 having the 80th grayscale gradation. Since the third unit buffer UB3 outputs the gradation voltage VS80 by using an interpolation method similar to that of the first unit buffer UB1 and the second unit buffer UB2, a brightness reversal phenomenon between the gradation voltages output by the first to third unit buffers UB1 to UB3 may not occur.

FIG. 10 is a graph illustrating an input voltage and an output voltage of each of the first unit buffer UB1 and the third unit buffer UB3 in the exemplary embodiment of FIG. 9. Referring to FIG. 10, similar to the case of the first unit buffer UB1, as the third unit buffer UB3 also outputs a gradation voltage using an interpolation method, occurrence of a period in which the brightness is reversed in both of the input voltage and the output voltage may be prevented. Referring to the output voltage illustrated in the graph of FIG. 10, the gradation voltage VS80 output by the third unit buffer UB3 may be higher than the gradation voltage VS79 output by the first unit buffer UB1, even in the rising period RP in which the output voltage increases, unlike the graph of FIG. 8. Thus, the gradation voltage VS80 output by the third unit buffer UB3 may have a value greater than that of the gradation voltage VS79 output by the first unit buffer UB1, in the entirety of one horizontal period.

On the other hand, in an exemplary embodiment of the present inventive concept, the interpolation method may only be applied to unit buffers outputting gradation voltages included within a predetermined range. For example, the interpolation method may be uniformly applied to unit buffers outputting a gradation voltage higher than a first voltage and lower than a second voltage, while the interpolation method may not be applied to unit buffers outputting a gradation voltage lower than the first voltage or higher than the second voltage. This may prevent an error from occurring when at least portions of transistors constituting operational amplifiers of the unit buffers do not operate, in a case in which portions of gradation voltages are generated by the interpolation method, which will be described below with reference to FIG. 11.

Referring to FIG. 11, noninverting input terminals of a fourth unit buffer UB4 may commonly receive one gamma voltage VG0, different from the first to third unit buffers UB1 to UB3, which receive two different voltages having different magnitudes from among gamma voltages VG0 to VG255 (e.g., the gamma voltages VG), to output an average value of the voltages as a gradation voltage. The condition for connecting the noninverting input terminals to one gamma voltage VG0, such as those of the fourth unit buffer UB4, may be defined by a gradation voltage to be output, which is lower than a predetermined first voltage or higher than a predetermined second voltage. The first voltage and the second voltage may be appropriately selected according to exemplary embodiments of the present inventive concept.

In an exemplary embodiment of the present inventive concept, a decoder unit may determine whether to connect noninverting input terminals of each of unit buffers to one gamma line, by comparing first image data obtained by converting the first voltage into 8 bits and second image data obtained by converting the second voltage into 8 bits, with image data received from a latch circuit unit. For example, assuming that the first image data is 00001111 and the second image data is 11110000, when the image data is less than 00001111 or greater than 11110000, the decoder unit may commonly connect the noninverting input terminals of the unit buffer, which outputs a gradation voltage corresponding to relevant image data, to one gamma line. Values of the first image data and the second image data are not fixed to these values, and may be variously modified.

Figure 12:
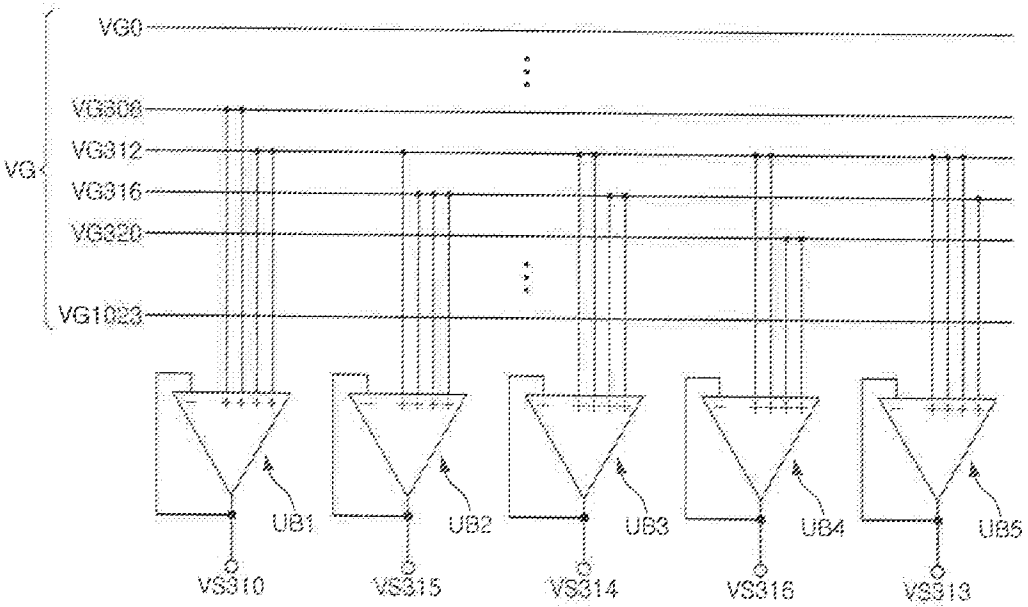
FIGS. 12 and 13 are drawings illustrating operations of a source driver according to an exemplary embodiment of the present inventive concept.
Figure 13:
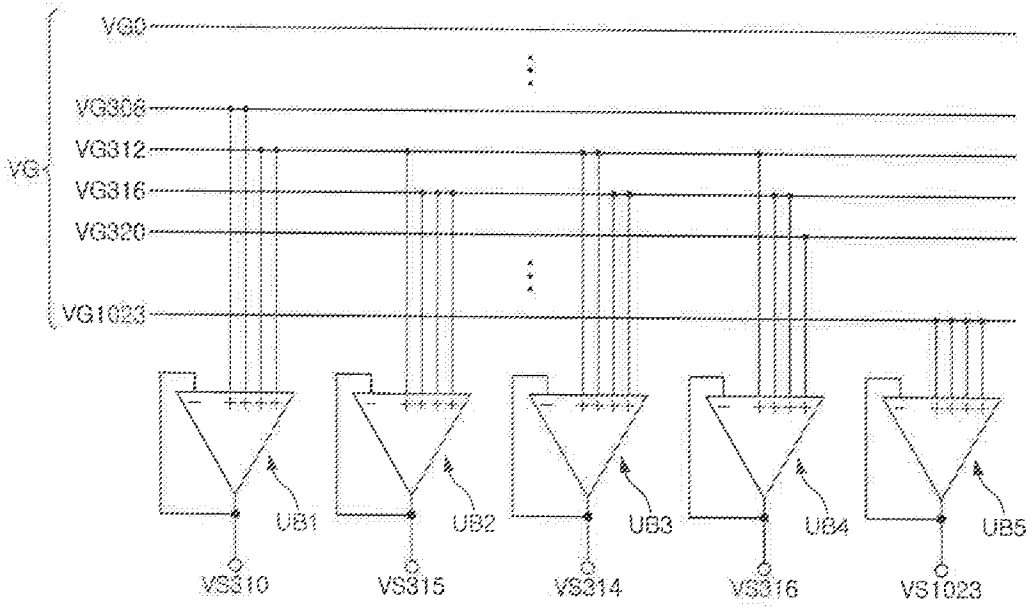

FIGS. 12 and 13 are drawings illustrating operations of a source driver according to an exemplary embodiment of the present inventive concept.

In an exemplary embodiment of the present inventive concept described with reference to FIGS. 12 and 13, image data received by a source driver may be 10-bit data. In addition, an interpolation method may be applied to two bits among bits of image data of unit buffers, and thus, an operational amplifier of each of the unit buffers may have four noninverting input terminals.

Referring to FIG. 12, each of a plurality of unit buffers UB1 to UB5 may receive at least portions of gamma voltages VG0 to VG1023 (e.g., the gamma voltages VG) through noninverting input terminals. For example, two of noninverting input terminals of the first unit buffer UB1 may be connected to a gamma line supplying a gamma voltage VG308 having a 308th grayscale gradation, and the remaining two noninverting input terminals may be connected to a gamma line supplying a gamma voltage VG312 having a 312th grayscale gradation. Thus, the first unit buffer UB1 may output a gradation voltage VS310 having a $310^{th}$ grayscale gradation, which is an average value of the gamma voltages VG308 and VG312 input to the noninverting input terminals.

The first to fifth unit buffers UB1 to UB5 may output average values of gamma voltages input through the noninverting input terminals, thus outputting gradation voltages of gradations which are not directly provided by the gamma voltages VG. In the exemplary embodiment illustrated in FIG. 12, the noninverting input terminals of the first through fifth unit buffers UB1 to UB5 may receive two different gamma voltages VG. Thus, a brightness reversal phenomenon may be prevented from occurring in the outputs of the first to fifth unit buffers UB1 to UB5.

In an exemplary embodiment of the present inventive concept, when a gradation voltage of a gradation directly provided by one of the gamma voltages VG is within a predetermined range, the unit buffers may output a gradation voltage corresponding thereto, using the interpolation method. Referring to FIG. 12, the fourth unit buffer UB4, outputting a gradation voltage VS316 having a 316th grayscale gradation, may receive a gamma voltage VG312 having a 312th grayscale gradation and a gamma voltage VG320 having a 320th grayscale gradation through noninverting input terminals. Thus, the fourth unit buffer UB4 may generate and output the gradation voltage VS316 having the 316th grayscale gradation, corresponding to an average value of the gamma voltages VG312 and VG320 received through the noninverting input terminals, using the interpolation method.

As a result, all of the first through fifth unit buffers UB1 to UB5 may output gradation voltages using the interpolation method, such that the magnitude of input voltages may be prevented from being reversed in rising periods in which input voltages of the first to fifth unit buffers UB1 to UB5 rise. In the first to fifth unit buffers UB1 to UB5 operating at a relatively high speed, an output voltage almost reflects an input voltage as is. Thus, in periods in which the output voltages of the first to fifth unit buffers UB1 to UB5 rise, the magnitude of the output voltages may also be prevented from being reversed. Thus, a phenomenon in which brightness is reversed in a display panel displayed to a user's eyes may be significantly reduced.

On the other hand, in an exemplary embodiment of the present inventive concept, noninverting input terminals of a unit buffer, outputting a certain range of gradation voltage, may receive one common voltage. Referring to FIG. 13, for example, when a fifth unit buffer UB5 outputs a gradation voltage VS1023 having a 1023rd grayscale gradation, noninverting input terminals of the fifth unit buffer UB5 may commonly receive a gamma voltage VG1023 having a 1023rd grayscale gradation. As described above, noninverting input terminals of an input buffer outputting a gradation voltage lower than a first voltage or higher than a second voltage may commonly receive a gamma voltage having the same grayscale gradation as that of a relevant gradation voltage to be output.

Referring to FIG. 13, the fourth unit buffer UB4 may receive three different gamma voltages VG312, VG316, and VG320 through noninverting input terminals. Although the fourth unit buffer UB4 has a gamma line supplying the gamma voltage VG316 corresponding to a gradation voltage VS316 having a $316^{th}$ grayscale gradation to be output by the fourth unit buffer UB4, the fourth unit buffer UB4 may receive other gradation gamma voltages VG312 and VG320 together. Referring to the exemplary embodiments of FIGS. 12 and 13, it can be understood that even in the case in which the gradation voltages having the same grayscale gradation are output, the combination of the gamma voltages input to noninverting input terminals of the unit buffers UB1 to UB5 may be variously modified.

Figure 14:
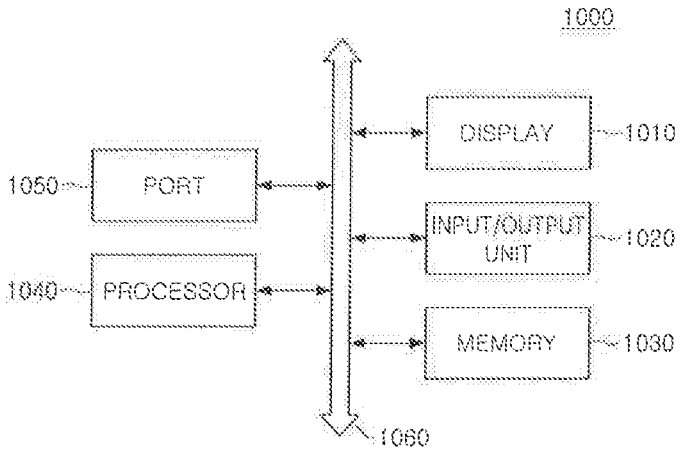
FIG. 14 is a block diagram of an electronic device including a display device according to an exemplary embodiment of the present inventive concept.

FIG. 14 is a block diagram of an electronic device including a display device according to an exemplary embodiment of the present inventive concept.

Referring to FIG. 14, an electronic device 1000 according to an exemplary embodiment may include a display 1010, an input/output device 1020, a memory 1030, a processor 1040, a port 1050, and the like. Examples of the electronic device 1000 may include a television set, a desktop computer, or the like, as well as a mobile device such as a smartphone, a tablet PC, a laptop computer, or the like. Components such as the display 1010, the input/output device 1020, the memory 1030, the processor 1040, the port 1050, and the like may communicate with one another via a bus 1060.

The display 1010 may include a display driver and a display panel. In an exemplary embodiment of the present inventive concept, the display driver may display image data transmitted by the processor 1040 via the bus 1060 depending on an operating mode. The display driver may generate gamma voltages of which the number corresponds to the number of bits of the image data transmitted by the processor 1040, and may select at least portions of the gamma voltages, based on the image data, to input to unit buffers.

In an exemplary embodiment of the present inventive concept, two or more gamma voltages having different magnitudes may be input to input terminals of the unit buffers, which output gradation voltages within a predetermined range. For example, as the unit buffers output gradation voltages using an interpolation method, the brightness of the gradation voltages output by the unit buffers may be prevented from being reversed and displayed on the display panel.

As set forth above, in the case of a source driver according to exemplary embodiments of the present inventive concept, with respect to unit buffers therein outputting output voltages within a predetermined range, at least portions of input voltages for generating the output voltages may have different values. Thus, a brightness reversal phenomenon due to a difference in output voltages of the unit buffers may be prevented from occurring, and a display driver may be miniaturized by reducing the number of gamma lines supplying gamma voltages.

While the present inventive concept has been shown and described above with reference to exemplary embodiments thereof, it will be apparent to those of ordinary skill in the art that modifications and variations in form and details may be made thereto without departing from the spirit and scope of the present inventive concept as set forth by the following claims.

What is claimed is:

1. A source driver comprising:

a buffer unit including a plurality of unit buffers corresponding to a plurality of source lines, wherein each of the plurality of unit buffers includes a plurality of input terminals and an output terminal connected to at least one of the plurality of source lines; and a decoder unit configured to receive image data and a plurality of gamma voltages, and input at least one of the plurality of gamma voltages to the plurality of input terminals of each of the plurality of unit buffers, using the image data, wherein the decoder unit inputs two or more of the plurality of gamma voltages, having different magnitudes, to the plurality of input terminals of each of first unit buffers among the plurality of unit buffers, and the first unit buffers output a gradation voltage higher than a first voltage and lower than a second voltage, and wherein the decoder unit commonly inputs at least one of the plurality of gamma voltages to the plurality of input terminals of a second unit buffer among the plurality of unit buffers, and the second unit buffer is different from the first unit buffers.

2. The source driver of claim 1, wherein the decoder unit inputs a gamma voltage, having the same magnitude as a magnitude of an output voltage of the second unit buffer, to the plurality of input terminals of the second unit buffer.

3. The source driver of claim 1, wherein an output voltage of the second unit buffer is lower than the first voltage or is higher than the second voltage.

4. The source driver of claim 1, wherein the second unit buffer comprises a plurality of second unit buffers, and the number of the plurality of second unit buffers is lower than the number of the first unit buffers.

5. The source driver of claim 1, further comprising:

a latch circuit unit configured to input the image data to the decoder unit; and a shift register configured to control sampling timing of the latch circuit unit to allow the image data to be sequentially stored in the latch circuit unit.

6. The source driver of claim 1, wherein an output voltage of each of the first unit buffers has an average value of gamma voltages input to respective input terminals.

7. The source driver of claim 1, wherein each of the plurality of unit buffers comprises a plurality of first input terminals configured to receive at least a portion of the plurality of gamma voltages, and a second input terminal configured to receive an output voltage through a feedback path.

8. The source driver of claim 7, wherein portions of the plurality of first input terminals included in at least one of the first unit buffers receive gamma voltages having the same magnitude.

9. The source driver of claim 8, wherein each of the first unit buffers comprises four or more of the first input terminals.

10. A display driver comprising:

a buffer unit including a plurality of unit buffers, wherein each of the plurality of unit buffers includes an output terminal and a plurality of input terminals;

a plurality of gamma lines configured to provide a plurality of gamma voltages; and a decoder unit connecting two or more gamma lines among the plurality of gamma lines to the plurality of input terminals included in each of first unit buffers among the plurality of unit buffers, wherein the first unit buffers output a gradation voltage within a predetermined range, wherein during a predetermined period, the plurality of input terminals included in one of the first unit buffers are connected to first gamma lines among the plurality of gamma lines, and the plurality of input terminals included in another of the first unit buffers are connected to second gamma lines among the plurality of gamma lines.

11. The display driver of claim 10, wherein the gradation voltage output by each of the first unit buffers has an average value of gamma voltages provided by the two or more gamma lines connected to respective input terminals.

12. The display driver of claim 10, wherein the decoder unit commonly connects at least portions of the plurality of input terminals included in at least one of the first unit buffers to one of the plurality of gamma lines.

13. The display driver of claim 12, wherein the decoder unit connects the plurality of input terminals included in at least one of the first unit buffers to three or more different gamma lines among the plurality of gamma lines.

14. The display driver of claim 10, wherein the predetermined period is a period of a horizontal synchronization signal of a display device.

15. The display driver of claim 14, wherein an average value of gamma voltages provided by the first gamma lines is less than an average value of gamma voltages provided by the second gamma lines.

16. The display driver of claim 15, wherein during the predetermined period, the gradation voltage output by the first unit buffer connected to the first gamma lines is lower than the gradation voltage output by the first unit buffer connected to the second gamma lines.

17. A source driver comprising:

a buffer unit including a plurality of unit buffers, wherein each of the plurality of unit buffers includes a plurality of first input terminals configured to receive first input voltages, a second input terminal configured to receive an output voltage through a feedback path, and an output terminal configured to output the output voltage, and the output voltage has an average value of the first input voltages; and a decoder unit configured to control the output voltage of each of the plurality of unit buffers, using image data, and when the image data is within a predetermined range, to select a gamma voltage having a magnitude different from a magnitude of the output voltage, as at least one of the first input voltages, wherein the decoder unit selects, a gamma voltage having the same magnitude as a magnitude of the output voltage, as the first input voltages, when the output voltage is not within the predetermined range.

18. The source driver of claim 17, wherein the predetermined range is a range in which the image data is higher than a first reference value and lower than a second reference value.

* * * * *